US005682764A

United States Patent [19]

Agrawal et al.

[11] Patent Number: 5,682,764

[45] Date of Patent: Nov. 4, 1997

[54] THREE COLUMN CRYOGENIC CYCLE FOR THE PRODUCTION OF IMPURE OXYGEN AND PURE NITROGEN

[75] Inventors: Rakesh Agrawal, Emmaus; Zbigniew Tadeusz Fidkowski, Macungie, both of Pa.

[73] Assignee: Air Products and Chemicals, Inc., Allentown, Pa.

[21] Appl. No.: 738,158

[22] Filed: Oct. 25, 1996

[51] Int. Cl.[6] ..... F25J 1/00

[52] U.S. Cl. ..... 62/646; 62/900

[58] Field of Search ..... 62/646, 900

[56] References Cited

U.S. PATENT DOCUMENTS 3,210,951 10/1965 Gaumer, Jr. .
3,605,423 9/1971 Stoklosinski ..... 62/900
4,453,957 6/1984 Pahade et al. .
4,617,036 10/1986 Suchdeo et al. .
4,702,757 10/1987 Kleinberg .
5,069,699 12/1991 Agrawal .
5,341,646 8/1994 Agrawal et al. ..... 62/900
5,582,032 12/1996 Shelton et al. ..... 62/643

*Primary Examiner*—Ronald C. Capossela
*Attorney, Agent, or Firm*—Willard Jones, II

[57] ABSTRACT

A cryogenic process for producing impure oxygen and/or substantially pure nitrogen utilizes a classic double column arrangement and an additional third column operating at a medium pressure, i.e. between the pressure of the higher pressure stage and the lower pressure stage of the double column system. A portion of the feed air is separated in the stages of the double column system, and another portion of the feed air is distilled in the medium pressure stage. Crude liquid oxygen from the higher pressure stage and/or the medium pressure stage is reduced in pressure and boiled in a reboiler/condenser at the top of the medium pressure column. The vaporized crude liquid oxygen from the top reboiler/condenser of the medium pressure column is subsequently introduced as a vapor feed to the lower pressure stage, which reduces irreversibilities of separation in the lower pressure stage.

15 Claims, 10 Drawing Sheets

211PUS05441

211PUS05441

211PUS05441

211PUS05441

211PUS05441

211PUS05441

THREE COLUMN CRYOGENIC CYCLE FOR THE PRODUCTION OF IMPURE OXYGEN AND PURE NITROGEN

BACKGROUND OF THE INVENTION

The present invention pertains to the production of substantially pure nitrogen and impure oxygen in a cryogenic air separation system.

Substantially pure nitrogen (namely nitrogen purity of at least 99.9 mole %) and impure oxygen (namely oxygen purity lower than about 98 mole %) are increasingly used in industry. For example, nitrogen and impure oxygen are used in petrochemical plants, gas turbines for power generation, glass production, and in the pulp and paper industry. In certain circumstances, only impure oxygen is required as a product from a cryogenic distillation plant and nitrogen is discarded as waste. In other cases, such as with nitrogen generators, impure oxygen constitutes a waste stream and nitrogen is the desired product. Generally, in a cryogenic distillation plant, production of impure oxygen can be combined with production of pure nitrogen. Numerous processes for the production of impure oxygen and/or nitrogen are known.

For example, U.S. Pat. No. 3,210,951 discloses a dual reboiler process in which a fraction of the feed air is condensed in a reboiler/condenser providing reboil for the bottom section of the low pressure column. Overhead vapor from the high pressure column is condensed in a second reboiler/condenser vaporizing an intermediate liquid stream, which is then delivered to the low pressure column. In comparison with a classic double column, single reboiler cycle, this dual reboiler arrangement reduces the irreversibility of the distillation process in the low pressure column and consequently decreases the feed air pressure, thereby saving power. U.S. Pat. No. 4,702,757 discloses a dual reboiler process in which a portion of the feed air is only partially condensed, reducing the feed air pressure even more.

U.S. Pat. No. 4,453,957 describes a cryogenic rectification process for the production of nitrogen at relatively high purity and at relatively high pressure in a classic double column arrangement with an additional reboiler/condenser at the top of the low pressure column. An impure oxygen waste stream is vaporized at the top reboiler/condenser to provide necessary reflux for the low pressure column. U.S. Pat. No. 4,617,036 discloses another cryogenic rectification process to recover nitrogen in large quantities and at relatively high pressure. In this system, an additional side reboiler/condenser is used to condense high pressure nitrogen gas against waste oxygen at reduced pressure.

In U.S. Pat. No. 5,069,699, a three column nitrogen generator is described. Specifically, the system includes a classic two stage, dual reboiler/condenser distillation column and an additional, discrete third stage having a pressure higher than the pressure of the high pressure stage of the two stage column. In this system, the bottom reboiler/condenser in the low pressure stage is used to condense nitrogen, and crude oxygen is fed to the low pressure stage as a liquid.

A conventional double column, dual reboiler cycle which has been used to produce these gases is shown in FIG. 1. The inclusion of a second reboiler/condenser in the low pressure column serves to reduce the specific power of the double column cycle. The cycle shown in FIG. 1 is considered to be one of the most efficient cycles for the production of impure oxygen. Nonetheless, analysis of composition profiles in the low pressure column for this system demonstrate a significant region of process irreversibility. This region is graphically represented by the area between the operating line "O" and the equilibrium line "E" shown in FIG. 2. In a strongly competitive market, there is a demand to reduce this irreversibility and the power required by this cycle even further.

BRIEF SUMMARY OF THE INVENTION

The present invention is directed to a method for operating a cryogenic distillation column having a higher pressure stage, a lower pressure stage, and a medium pressure stage to produce at least one of nitrogen and impure oxygen. Preferably, the cycle includes a dual stage column including the higher pressure stage and the lower pressure stage, along with a discrete third column which is the medium pressure stage having a pressure between the pressures of the higher pressure stage and the lower pressure stage. The present invention reduces irreversibilities of separation in the lower pressure stage by delivering crude oxygen as a vapor to the lower pressure stage. In addition, a portion of the feed air is introduced directly to the medium pressure stage, which results in power savings as compared to cycles which require the entire stream of feed air to be pressurized to the higher pressure of the higher pressure stage.

According to the present invention, a source of feed air is used to provide (a) a first feed air stream and (b) a second feed air stream having a pressure less than the pressure of the first feed air stream. The second feed air stream is introduced into the medium pressure stage for rectification into a medium pressure, oxygen-enriched liquid and a medium pressure nitrogen overhead stream. A first fraction of the first feed air stream is introduced into the higher pressure stage for rectification into a higher pressure, oxygen-enriched liquid and a higher pressure nitrogen overhead stream. The higher pressure nitrogen overhead stream is condensed against a liquid from the lower pressure stage to form higher pressure nitrogen condensate, a portion of which is returned to the higher pressure stage as reflux. The medium pressure, oxygen-enriched liquid and the higher pressure, oxygen-enriched liquid (or portions thereof) are reduced in pressure to form a reduced-pressure, oxygen-enriched liquid, which is used to condense the medium pressure nitrogen overhead stream, thereby forming an oxygen-enriched vapor stream and a medium pressure nitrogen condensate. The oxygen-enriched vapor stream is introduced to the lower pressure stage as a feed. A portion of the medium pressure nitrogen condensate is returned to the medium pressure stage as reflux. The remaining portions of at least one of the higher pressure nitrogen condensate and the medium pressure nitrogen condensate are introduced to the lower pressure stage as reflux for the lower pressure stage. Two product streams are withdrawn: (1) an oxygen-enriched product from a position near the bottom of the lower pressure stage; and (2) a nitrogen-enriched product from a position near the top of the lower pressure stage.

It is to be understood that both the foregoing general description and the following detailed description are exemplary, but are not restrictive, of the invention.

BRIEF DESCRIPTION OF THE SEVERAL VIEWS OF THE DRAWINGS

The invention is best understood from the following detailed description when read in connection with the accompanying drawings, in which.

DETAILED DESCRIPTION OF THE INVENTION

Figure 1:
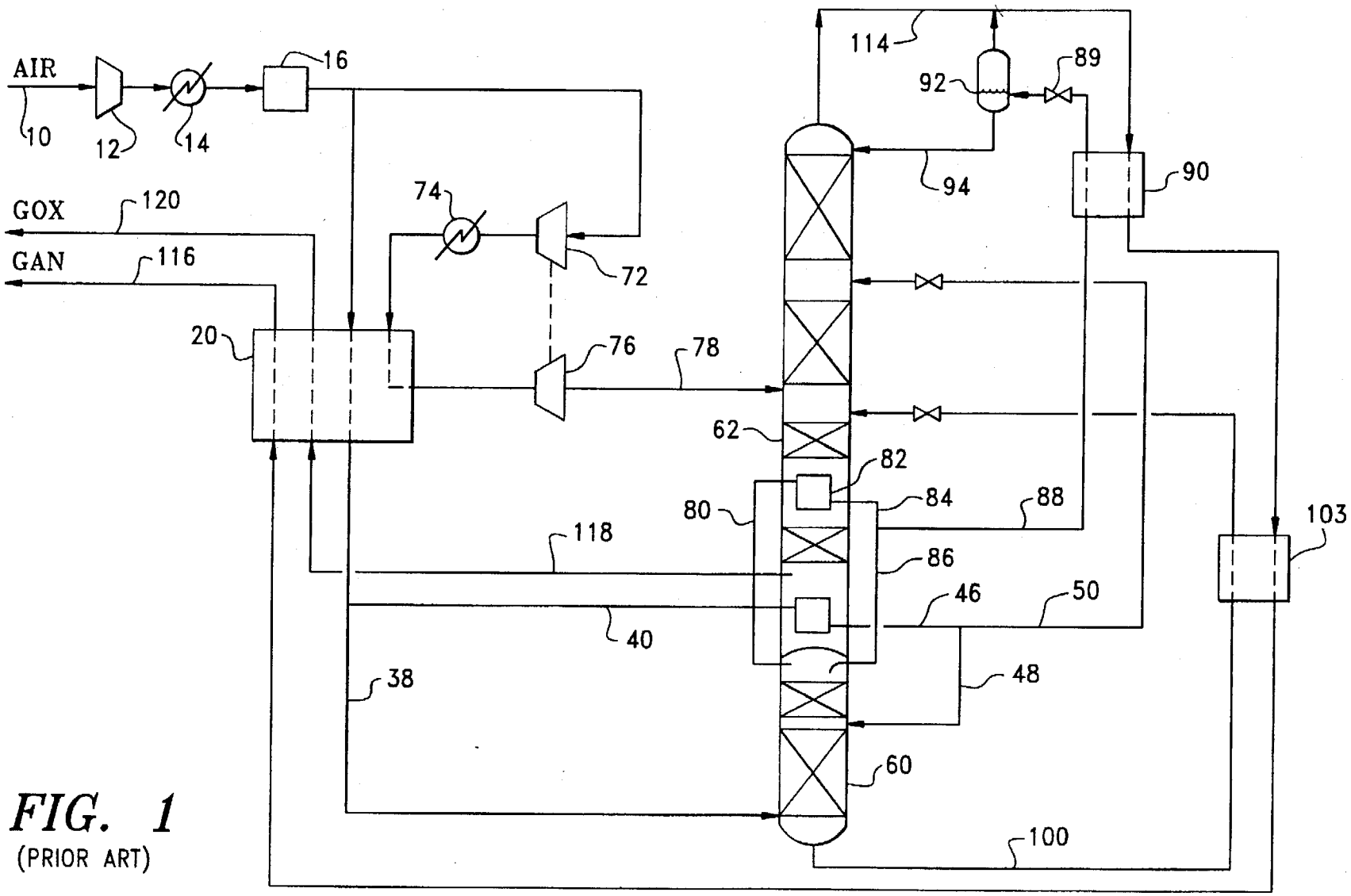
FIG. 1 (PRIOR ART)
FIG. 1 is a schematic diagram of a conventional double-column, dual reboiler cycle.

In general, the present invention calls for feed air to be introduced to at least one compressor, at least one heat exchanger, and at least one expander to provide (a) a medium pressure feed air stream and (b) a higher pressure feed air stream. In the preferred embodiment of the present invention shown in FIG. 3, which is a three-column, dual reboiler, impure oxygen cycle, a feed air stream in line 10 is compressed in compressor 12, cooled in heat exchanger 14, cleaned of water and carbon dioxide, preferably in molecular sieve adsorption unit 16, and divided into two streams: the medium pressure feed air stream in line 18 and stream in line 30.

Medium pressure feed air stream in line 18 is cooled in a main heat exchanger 20 to a cryogenic temperature and introduced as feed in line 22 to the medium pressure stage 24. There, the medium pressure feed air stream (along with another feed discussed below) is rectified into a medium pressure, oxygen-enriched liquid (withdrawn as a bottom product via line 110) and a medium pressure nitrogen overhead stream (withdrawn as an overhead vapor in line 105).

Compressed feed air stream in line 30 is further compressed in compressor 32, cooled in heat exchanger 34 against an external cooling fluid, and split into two: streams in lines 36 and 70. Stream in line 36 is cooled in main heat exchanger 20 close to its dew point and divided into two streams: a first fraction of the higher pressure feed air stream in line 38 and a second fraction of the higher pressure feed air stream in line 40. The first fraction of the higher pressure feed air stream in line 38 is introduced as a feed into the higher pressure stage 60 for rectification (along with another feed discussed below) into a higher pressure, oxygen-enriched liquid (withdrawn as a bottom product via line 100) and a higher pressure nitrogen overhead stream.

The second fraction of the higher pressure feed air stream in line 40 is condensed in a bottom reboiler/condenser 42, located in the bottom of the lower pressure stage 62, thereby forming liquefied feed air in line 46 and providing a part of the reboil necessary for the separation in the lower pressure stage 62. Liquefied feed air in line 46 may be divided into three streams: a first portion in line 48, a second portion in line 50, and a third portion in line 52, which form liquefied air feeds to higher pressure stage 60, medium pressure stage 24 and lower pressure stage 62, respectively. Alternatively, liquefied feed air in line 46 may be directed to only one of higher pressure stage 60, medium pressure stage 24 or, preferably, lower pressure stage 62, or any combination of any two of them. The operating pressures of the three stages can vary over wide ranges, such as 18–180 psia for lower pressure stage 62, 35–250 psia for medium pressure stage 24, and 55–350 psia for higher pressure stage 60.

The portion of the further compressed feed air stream in line 70 is compressed, then cooled and expanded and introduced as a lower pressure feed air stream to lower pressure stage 62. Specifically, the stream in line 70 is compressed in compander compressor 72, cooled in heat exchanger 74 against an external cooling fluid, cooled in main heat exchanger 20, and expanded in turbo-expander 76. Then, the stream is introduced via line 78 to lower pressure stage 62 as a lower pressure feed air stream.

As mentioned above, the first fraction of the higher pressure feed air stream in line 38 and the first portion of the liquefied air feed in line 48 are introduced to higher pressure stage 60, where they are rectified into the higher pressure, oxygen-enriched liquid withdrawn in line 100 and a higher pressure nitrogen overhead stream withdrawn in line 80. The higher pressure nitrogen overhead stream in line 80 is condensed against a liquid from lower pressure stage 62 to form higher pressure nitrogen condensate in line 84, a portion of which is returned to higher pressure stage 60 in line 86 as reflux. Specifically, the higher pressure nitrogen overhead stream is condensed in an intermediate reboiler/condenser 82 located in lower pressure stage 62 above bottom reboiler/condenser 42. As an alternative to using an intermediate reboiler/condenser in lower pressure stage 62, a separate device, disposed near and connected to lower pressure stage 62 by appropriate vapor and liquid lines, may be utilized. The remaining portion of the higher pressure nitrogen condensate is withdrawn via line 88, subcooled in a heat exchanger 90, reduced in pressure across an isenthalpic Joule-Thompson valve 89 and flashed in a separator 92. The resulting low pressure nitrogen reflux is introduced via line 94 close to the top of lower pressure stage 62.

As mentioned above, medium pressure feed air stream in line 22 and second portion of liquefied feed air in line 50 are introduced to medium pressure stage 24, where they are rectified into a medium pressure, oxygen-enriched liquid (withdrawn via line 110 as a bottom product) and a medium pressure nitrogen overhead stream, which is condensed in a top reboiler/condenser 106 via line 105. A portion of the medium pressure nitrogen condensate provides reflux for medium pressure stage 24, and the remaining portion in line 112 is subcooled in heat exchanger 90 and reduced in pressure across an isenthalpic Joule-Thompson valve 91. The stream is then flashed in separator 92 to provide additional reflux to lower pressure stage 62 via line 94.

In all of the embodiments of the present invention, at least a portion of at least one of the medium pressure, oxygen-enriched liquid and the higher pressure, oxygen-enriched liquid is reduced in pressure to form a first reduced-pressure, oxygen-enriched liquid, and the first reduced-pressure, oxygen-enriched liquid is used as the cooling medium to condense the medium pressure nitrogen overhead stream in the top reboiler/condenser 106 of medium pressure stage 24. In the embodiment shown in FIG. 3, higher pressure, oxygen-enriched liquid in line 100 is first subcooled in heat exchanger 103, reduced in pressure across an isenthalpic Joule-Thompson valve 101 to form a second reduced-pressure oxygen-enriched liquid, then combined with medium pressure, oxygen-enriched liquid from line 110 coming from the bottom of medium pressure stage 24 to form a combined oxygen-enriched liquid, and either split into two streams in lines 102 and 104 or directed entirely to line 104. Stream in line 104 is reduced in pressure across an isenthalpic Joule-Thompson valve 107 and then vaporized in top reboiler/condenser 106, serving as the first reduced-pressure, oxygen-enriched liquid in line 104. The refrigeration provided by stream in line 104 provides the necessary reflux for medium pressure stage 24. The resulting vapor stream in line 108 is introduced to lower pressure stage 62, as an oxygen-enriched vapor stream. Stream in line 102 is optional, and for some operating conditions not necessary (i.e., the flow in line 102 may be zero). When there is flow in line 102, the stream in line 102 is reduced in pressure across an isenthalpic Joule-Thompson valve 109 and introduced into lower pressure stage 62.

Figure 2:
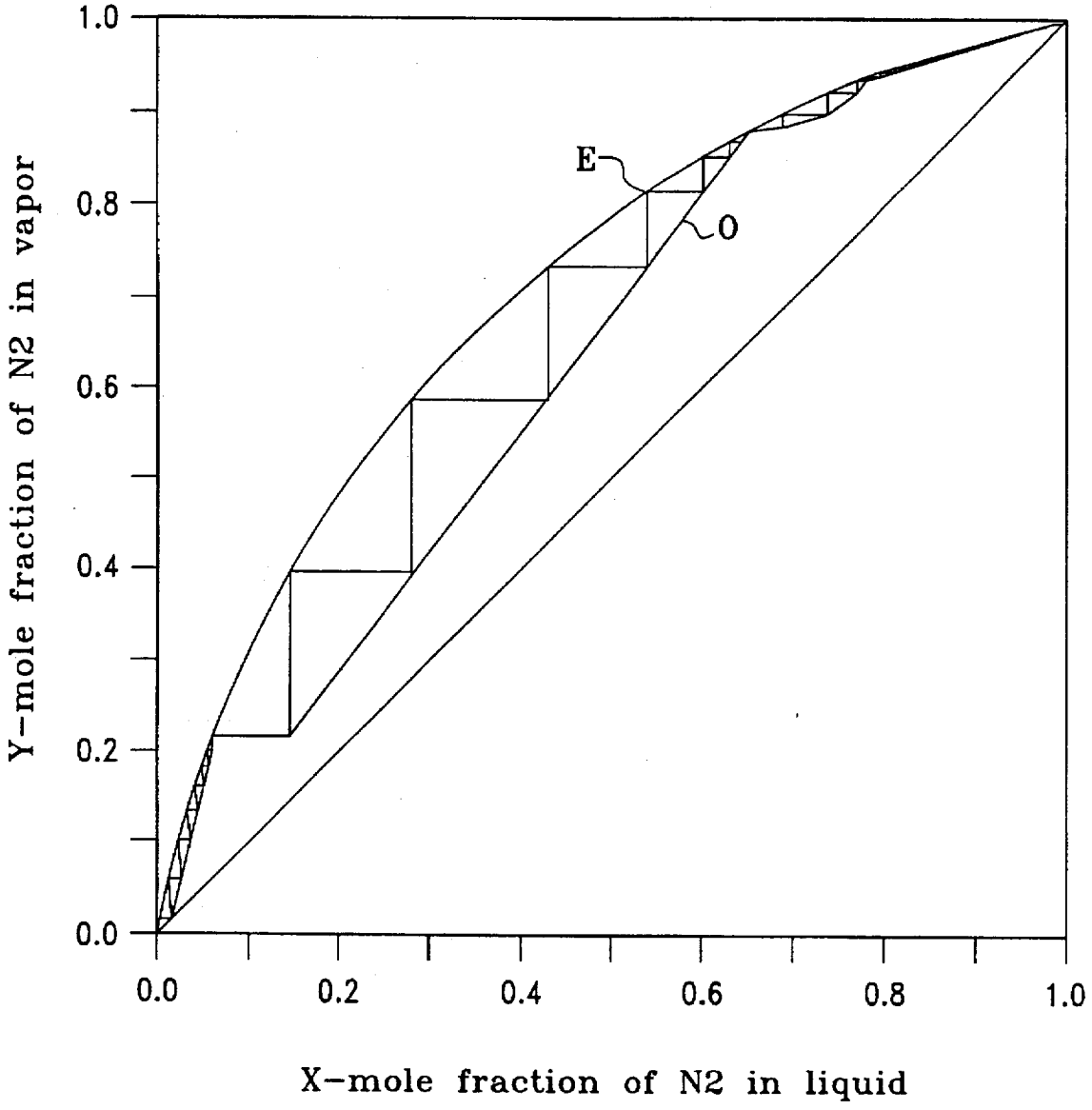
FIG. 2 (PRIOR ART)
FIG. 2 is a McCabe-Thiele diagram showing the equilibrium curve and operating curve of a system corresponding to FIG. 1.
Figure 3:
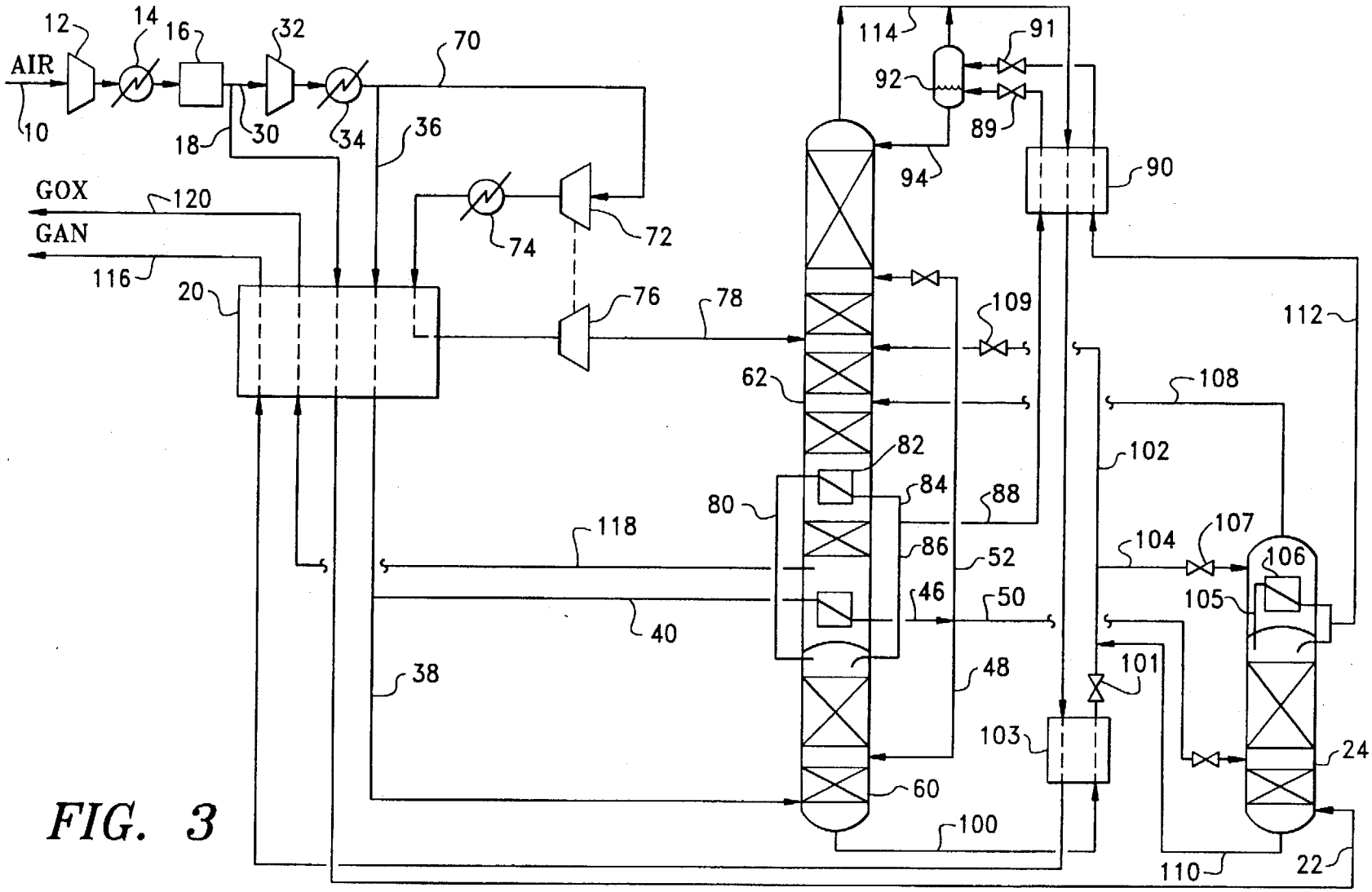
FIG. 3 is a schematic diagram of a first embodiment of the present invention.
Figure 4:
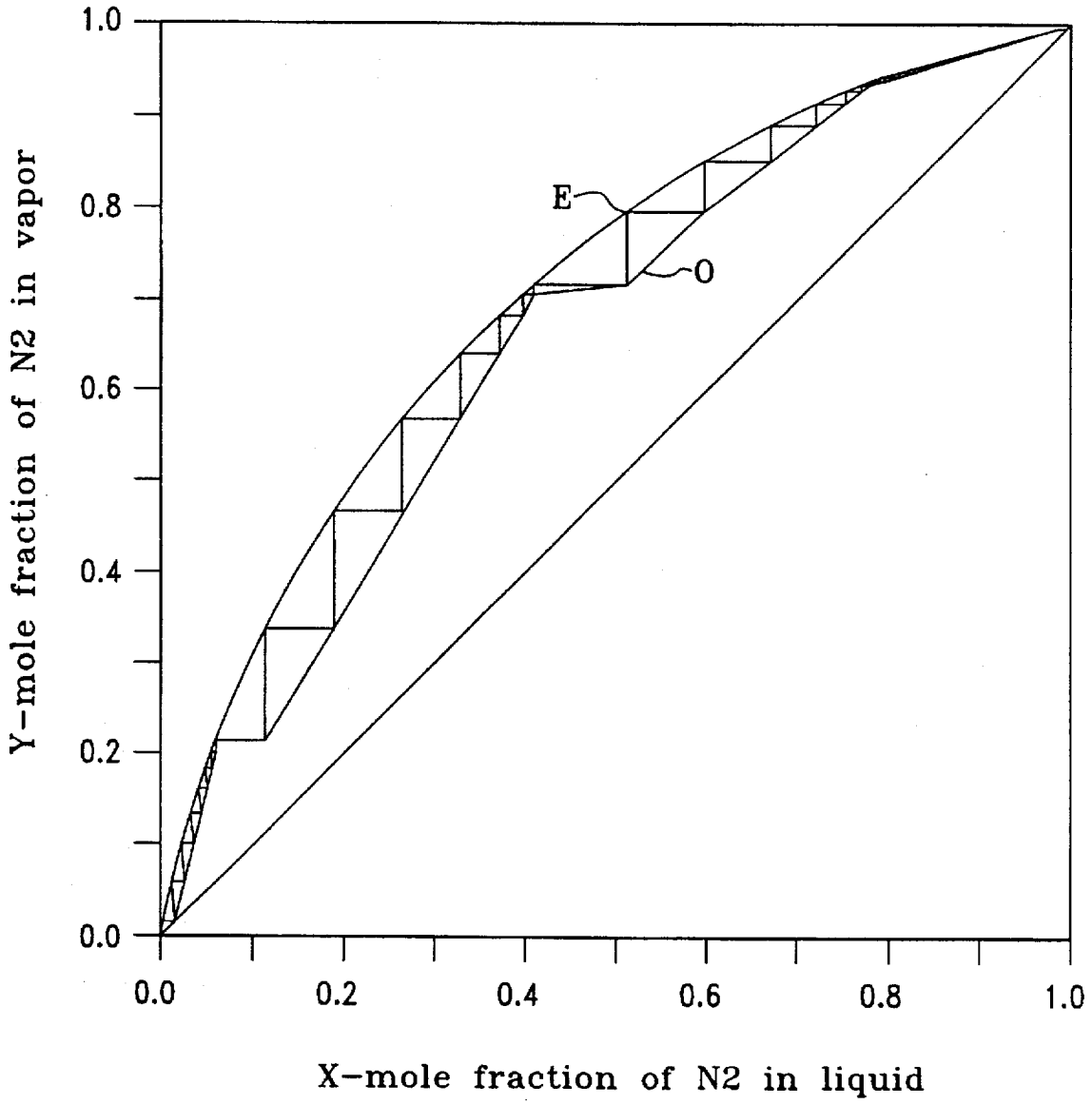
FIG. 4 is a McCabe-Thiele diagram showing the equilibrium curve and operating curve of a system corresponding to FIG. 3.

Introducing the oxygen-enriched stream in line 108 as a vapor, not as a liquid, to lower pressure stage 62 greatly reduces the irreversibility in the lower pressure stage 62. The corresponding McCabe-Thiele diagram for a system of FIG. 3 is shown in FIG. 4. When comparing this diagram to FIG. 2, it can be seen that the graphical representation of process irreversibilities, namely the area between the operating line "O" and the equilibrium line "E", is reduced in FIG. 4.

In all of the embodiments of the present invention, two streams are withdrawn: (1) an oxygen-enriched product from a position near the bottom of the lower pressure stage; and a nitrogen-enriched product from a position near the top of the lower pressure stage. Either product may be withdrawn as a liquid or a gas depending on the particular needs, although nitrogen is preferably withdrawn as a gas. In the embodiment shown in FIG. 3, gaseous nitrogen product in line 116 is withdrawn from the top of lower pressure stage 62 in line 114, combined with any flash gases from separator 92, and warmed up in: (1) heat exchanger 90 against higher pressure nitrogen condensate in line 88 and medium pressure nitrogen condensate in line 112, (2) heat exchanger 103 against higher pressure, oxygen-enriched liquid in line 100, and (3) main heat exchanger 20 against medium pressure feed air stream in line 22 and higher pressure feed air stream in line 36 and the stream from compander compressor 72 and heat exchanger 74. Also in the embodiment shown in FIG. 3, oxygen product 120 is recovered as a vapor from the bottom of lower pressure stage 62 in line 118 and is warmed up in main heat exchanger 20 against medium pressure feed air stream in line 22 and higher pressure feed air stream in line 36 and the stream from compander compressor 72 and heat exchanger 74.

Figure 5:
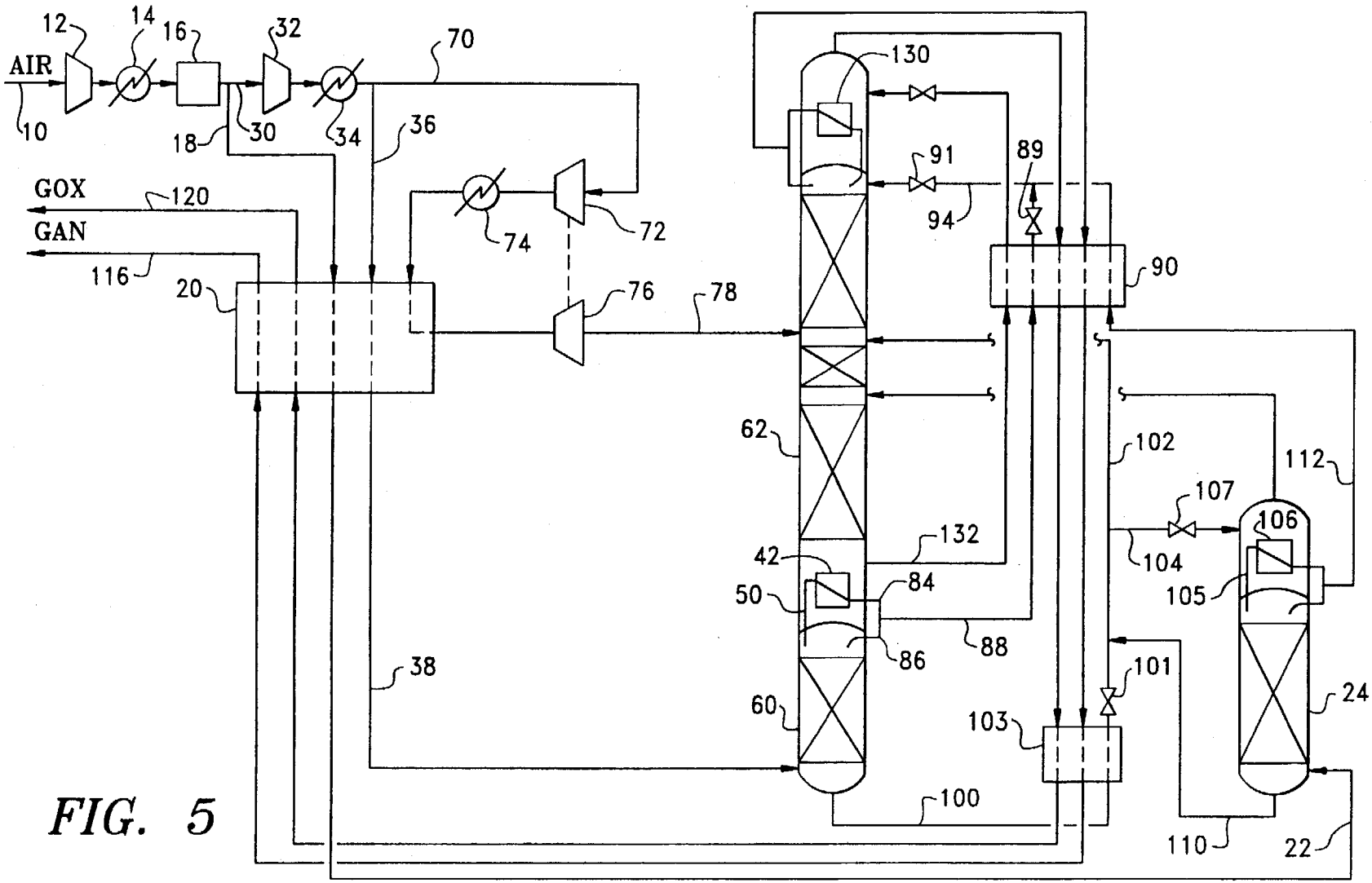
FIG. 5 is a schematic diagram of a second embodiment of the present invention.
Figure 6:
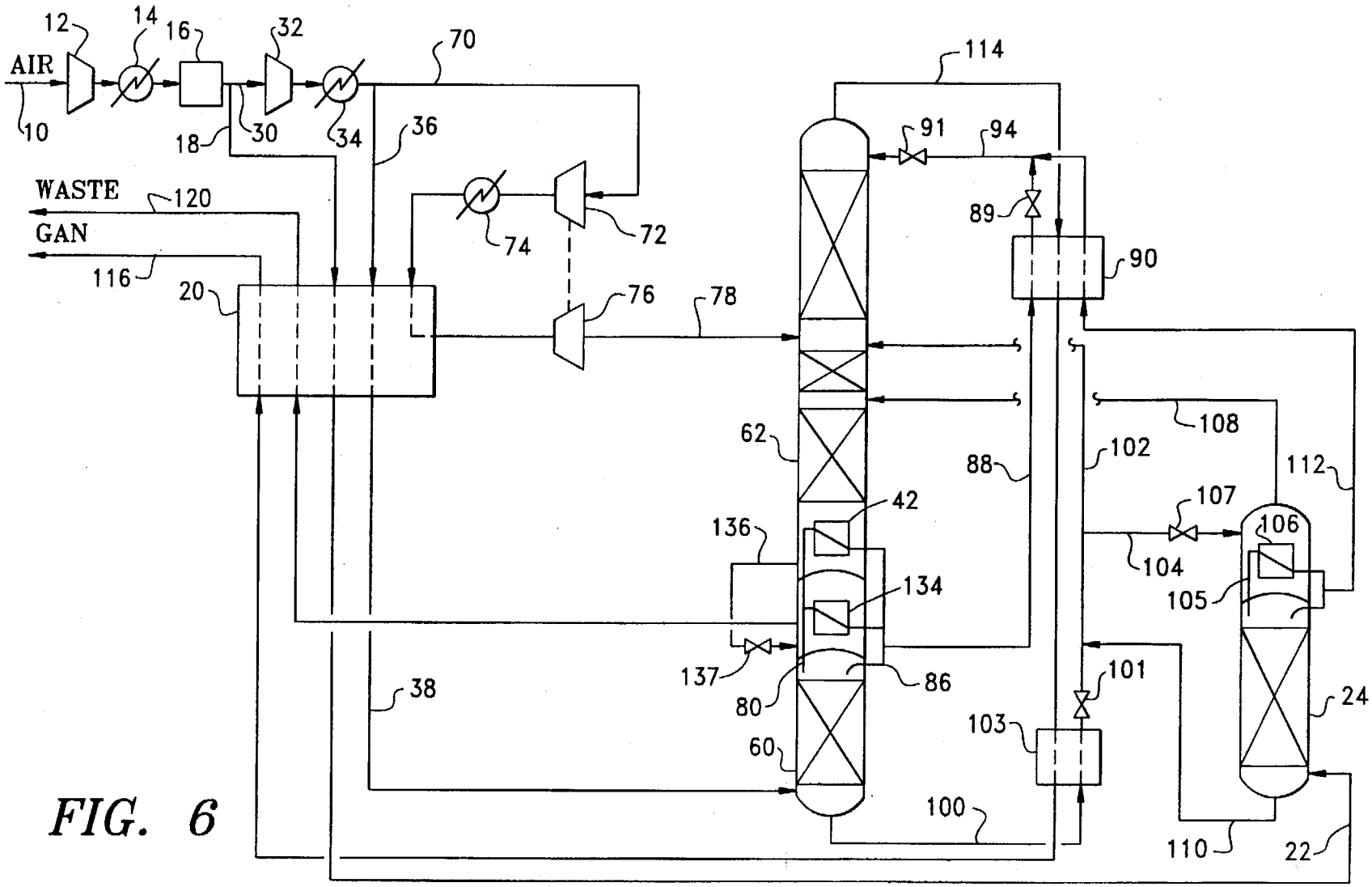
FIG. 6 is a schematic diagram of a third embodiment of the present invention.

Turning to the other embodiments of the present invention shown in FIGS. 5–10, in which the same reference numerals refer to the same elements as discussed above in connection with FIG. 3, the embodiments shown in FIG. 5 and in FIG. 6 are directed to using the medium pressure stage with a nitrogen generator. Such nitrogen plants also produce impure oxygen as a waste. A significant irreversibility region in the stripping section of the lower pressure stage exists when crude oxygen is supplied to the low pressure column as a liquid feed. The irreversibilities are greatly reduced by introduction of the third, medium pressure column, which allows crude oxygen to be supplied to the low pressure column in the form of vapor instead of liquid, as discussed above in connection with FIG. 3.

The embodiment shown in FIG. 5 differs from that of FIG. 3 in that there is no intermediate reboiler/condenser but instead there is a top reboiler/condenser 130 of lower pressure stage 62. Also, in the embodiment shown in FIG. 5, all of the further compressed feed air stream in line 36 is directed via line 38 to higher pressure stage 60. In this embodiment, the step of condensing higher pressure nitrogen overhead stream in line 80 against a liquid from lower pressure stage 62 includes introducing higher pressure nitrogen overhead stream in line 80 to a bottom reboiler/condenser 42 of lower pressure stage 62. In this embodiment, the oxygen-enriched stream is withdrawn as a liquid via line 132 from a position near the bottom of lower pressure stage 62 and introduced to top reboiler/condenser 130 of lower pressure stage 62 to provide additional reflux to lower pressure stage 62 and to vaporize the oxygen-enriched stream, which could be classified as a product for some uses, but is typically a waste stream in this embodiment. This oxygen-enriched stream is warmed in heat exchangers 90 and 103, as well as in main heat exchanger 20.

The embodiment shown in FIG. 6 differs from that of FIG. 3 in that there is no intermediate reboiler/condenser but instead there is a side reboiler/condenser 134 of lower pressure stage 62. Also, as in the embodiment shown in FIG. 5, all of the further compressed feed air stream in line 36 is directed via line 38 to higher pressure stage 60. In the embodiment shown in FIG. 6, the step of condensing higher pressure nitrogen overhead stream includes the steps of introducing a first portion of higher pressure nitrogen overhead stream to bottom reboiler/condenser 42 of lower pressure stage 62 and introducing a second portion of higher pressure nitrogen overhead stream to side reboiler/condenser 134 of lower pressure stage 62. Side reboiler/condenser 134 can be contained within the column of lower pressure stage 62 or situated next to it. Furthermore, the step of withdrawing an oxygen-enriched product from a position near the bottom of lower pressure stage 62 includes first withdrawing an oxygen-enriched product as a liquid from a position near the bottom of lower pressure stage 62 via line 136. This stream is reduced in pressure across an isenthalpic Joule-Thompson valve 137 to form a reduced-pressure, oxygen-enriched product which is delivered to side reboiler 134 and used to condense the second portion of the higher pressure nitrogen overhead stream.

Figure 7:
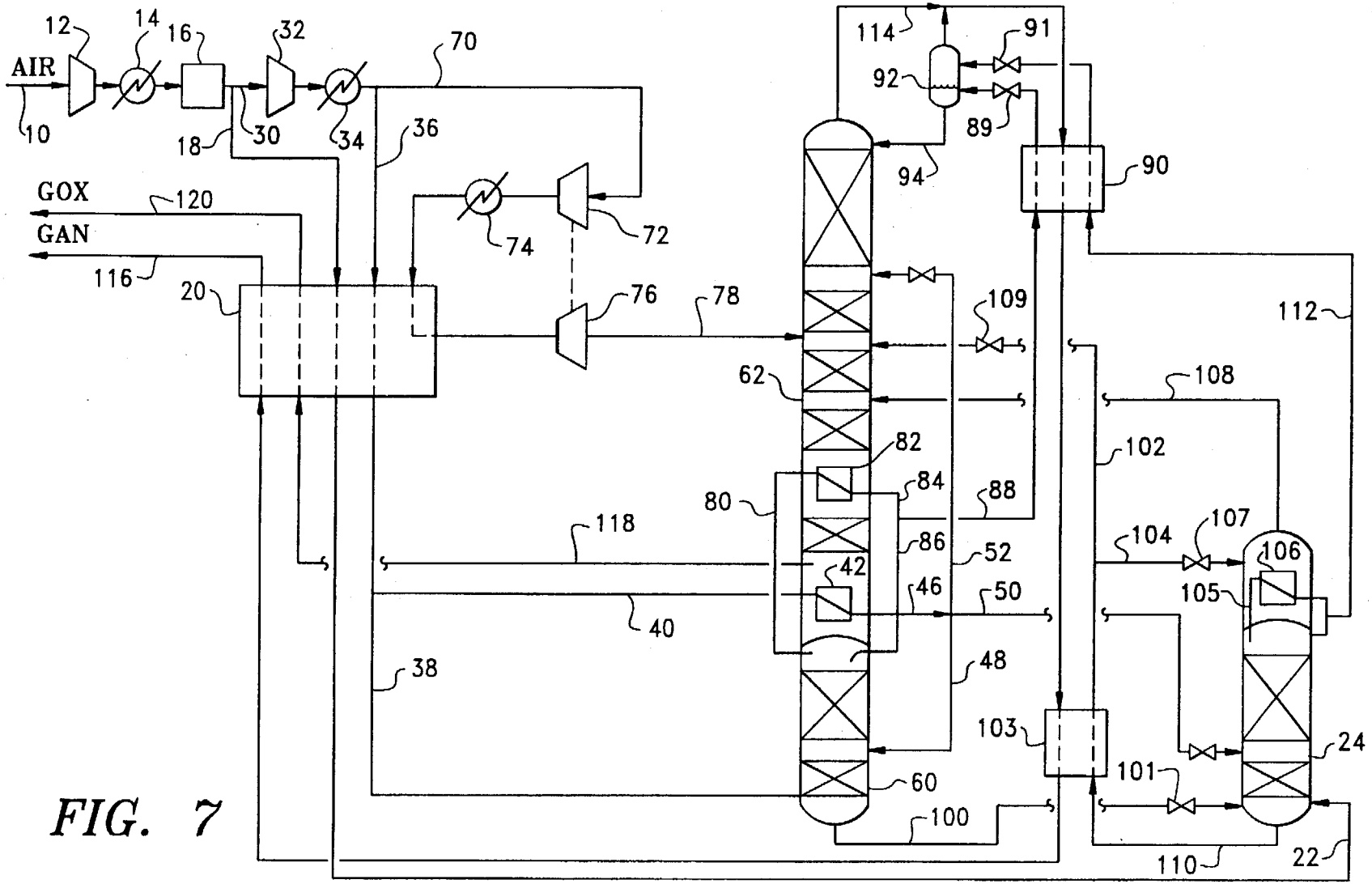
FIG. 7 is a schematic diagram of a fourth embodiment of the present invention.

Another embodiment of the present invention is shown in FIG. 7. This cycle differs from the cycle presented in FIG. 3 in the manner in which the higher pressure, oxygen-enriched liquid in line 100 is used. Specifically, the higher pressure, oxygen-enriched liquid stream in line 100 is reduced in pressure across valve 101 and introduced to the bottom of medium pressure stage 24 where it is flashed, thus providing extra reboil for medium pressure stage 24 and additional nitrogen reflux to the lower pressure stage. The medium pressure, oxygen-enriched liquid in line 110 is cooled in heat exchanger 103, reduced in pressure in an isenthalpic Joule-Thompson valve 107 in line 104, then introduced to top reboiler/condenser 106 of medium pressure stage 24. A portion of the medium pressure, oxygen-enriched liquid may be delivered to lower pressure stage 62 via line 102.

Figure 8:
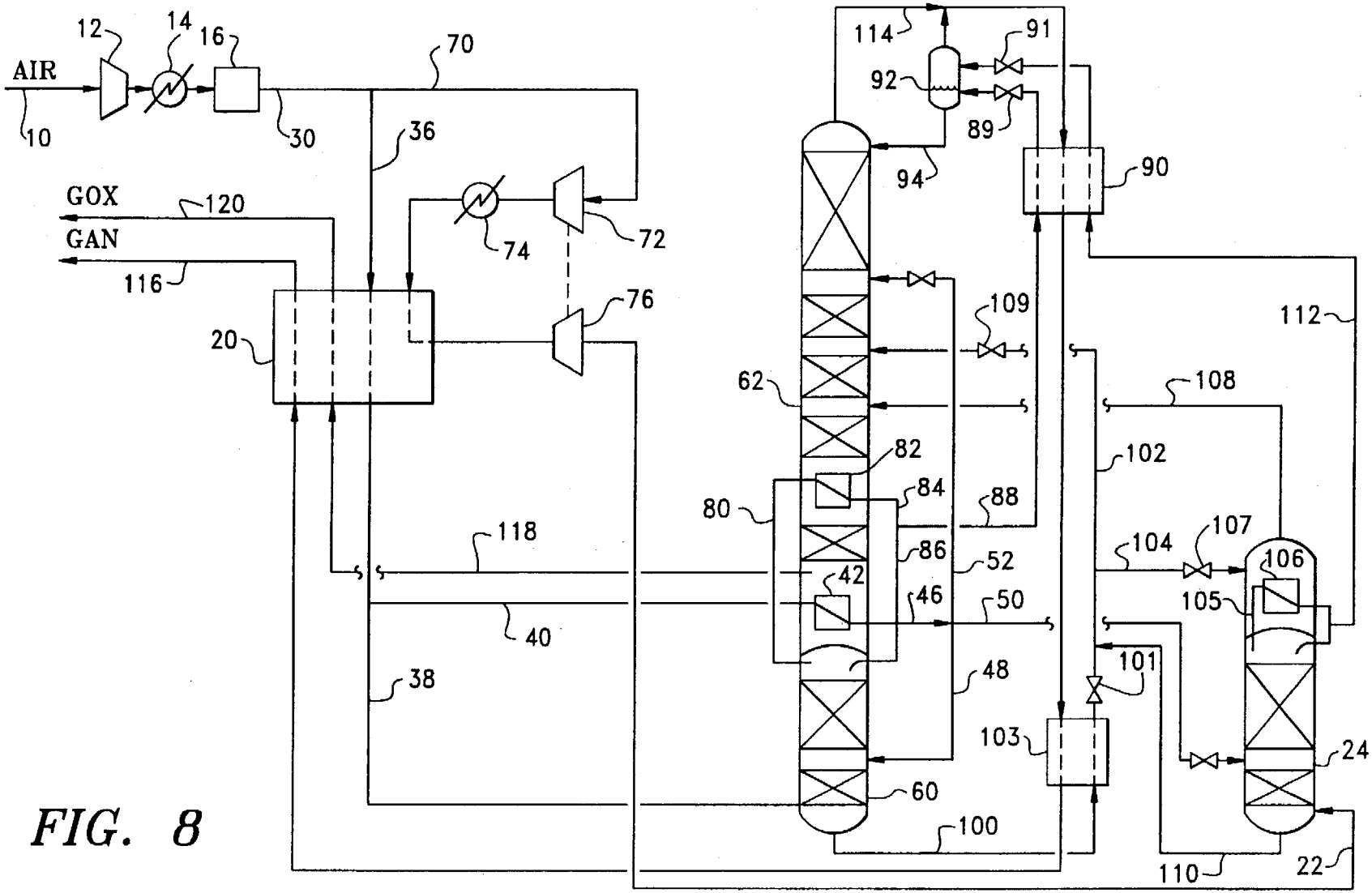
FIG. 8 is a schematic diagram of a fifth embodiment of the present invention.

The embodiment shown in FIG. 8 differs from the embodiment of FIG. 3 in that the entire feed air stream is compressed to a higher pressure to form the higher pressure feed air stream in line 30, then a portion of higher pressure feed air stream in line 70 is expanded in an expander 76 to form medium pressure feed air stream in line 22, as opposed to being delivered to lower pressure stage 62.

Figure 9:
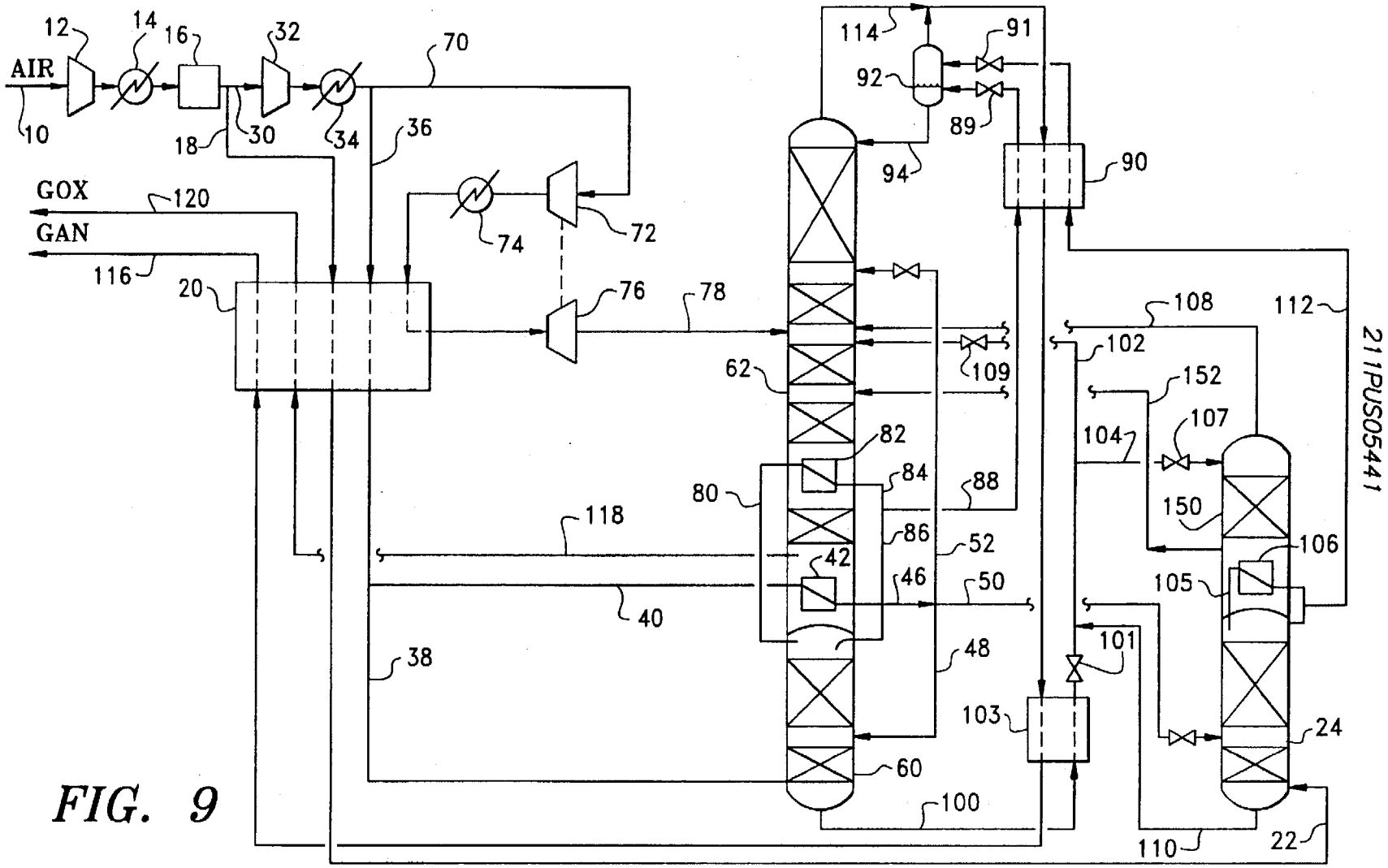
FIG. 9 is a schematic diagram of a sixth embodiment of the present invention.

The embodiment shown in FIG. 9 differs from the embodiment of FIG. 3 in that a small section of stages or packing 150 is added above top reboiler/condenser 106 of medium pressure stage 24. With the inclusion of additional stages or packing 150, the reduced-pressure, oxygen-enriched liquid is partially separated as it is being vaporized.

Specifically, it is separated into two portions: (1) a first portion having a first concentration which is withdrawn in line 152; and (2) a second portion having a second concentration, less pure in oxygen than the first concentration, which is withdrawn in line 108. Streams in line 152 and 108 are introduced to lower pressure stage 62 at different locations. Specifically, stream in line 108 is introduced above the point at which stream in line 152 is introduced to lower pressure stage 62. This embodiment further reduces the irreversibilities of separation in the lower pressure stage resulting in additional power savings.

Figure 10:
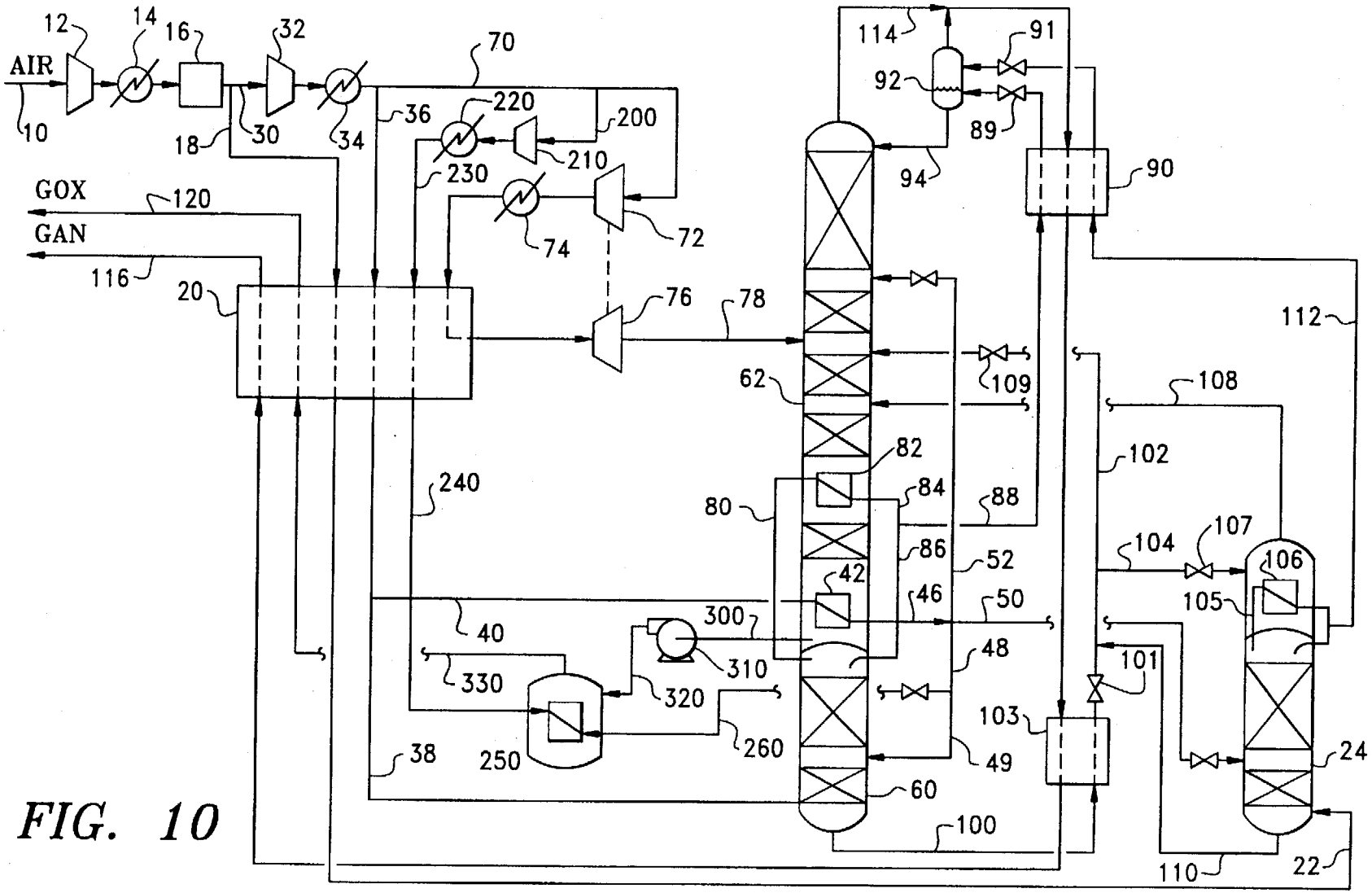
FIG. 10 is a schematic diagram of a seventh embodiment of the present invention.

The embodiment shown in FIG. 10 differs from the cycle of FIG. 3 by the manner in which oxygen product is withdrawn. Specifically, the embodiment shown in FIG. 10 is desirable if oxygen product is needed at a high pressure without the need to include an expensive oxygen compressor in the system. In this embodiment, oxygen-enriched product is withdrawn as a liquid from the bottom of lower pressure stage 62 via line 300. This stream may be pumped via pump 310 to the desired higher pressure. Alternatively, pump 310 may not be needed if a lower oxygen pressure is desired; specifically, several pounds of oxygen product pressure can be obtained due to the static head gain caused by the height difference between the point at which liquid oxygen is withdrawn from the lower pressure stage 62 and the point where it is boiled. Pressurized oxygen-enriched product in line 320 is then introduced to a heat exchanger 250, where it is vaporized and heated, exiting as stream in line 330. Stream in line 330 is further warmed in main heat exchanger 20.

The medium directed to heat exchanger 250, which is used to heat the pressurized oxygen-enriched product from line 320, is a highest pressure feed air stream in line 240. Stream in line 240 is obtained by removing a portion of stream in line 70 via line 200, boosting this portion to a sufficient pressure in auxiliary compressor 210, and cooling the stream in heat exchanger 220 to form stream in line 230 which is cooled further in main heat exchanger 20. Stream in line 240 is condensed in heat exchanger 250 to form liquefied feed air 260 which is joined with liquid air stream 48 to form liquefied air stream 49, which is subsequently delivered to higher pressure stage 60. Optionally, liquid air stream 260 could be introduced also to streams in lines 46, 50, or 52. Finally, separate heat exchanger 250 may not be necessary as oxygen could be boiled in main heat exchanger 20 under certain conditions.

EXAMPLES

In order to demonstrate the efficacy of the present invention, the following example was developed. In Table 1 below, the stream parameters are listed for the embodiment shown in FIG. 3. In Table 2, the mole fractions of the various streams are provided. The basis of the simulations was to produce gaseous oxygen at 95% purity at atmospheric pressure from 100 lbmol/hr of air at atmospheric conditions. In the simulations, the number of theoretical trays in higher pressure stage 60 was 25, the number of theoretical trays in medium pressure stage 24 was 20, and the number of theoretical trays in lower pressure stage 62 was 35.

TABLE 1

| Stream | Temperature | | Pressure | | Flow Rate | |
|---|---|---|---|---|---|---|
| in Line Number | (°F.) | (K) | (psi) | (kPa) | (lbmol/ hour) | gmole/s |
| 10 | 80.0 | 299.8 | 14.7 | 101.3 | 100.0 | 12.60 |
| 18 | 90.0 | 305.4 | 47.0 | 324.3 | 29.6 | 3.73 |
| 22 | −292.6 | 92.8 | 45.0 | 317.5 | 29.6 | 3.73 |
| 30 | 90.0 | 305.4 | 47.0 | 324.4 | 70.4 | 8.87 |
| 36 | 90.0 | 305.4 | 61.2 | 421.8 | 60.4 | 7.61 |
| 38 | −287.5 | 95.6 | 58.7 | 404.5 | 21.7 | 2.73 |
| 40 | −287.5 | 95.6 | 58.7 | 404.5 | 38.7 | 4.88 |
| 46 | −291.9 | 93,2 | 57.7 | 397.6 | 38.7 | 4.88 |
| 48 | −291.9 | 93.2 | 57.7 | 397.6 | 2.2 | 0.27 |
| 50 | −291.9 | 93.2 | 57.7 | 397.6 | 3.0 | 0.37 |
| 52 | −291.9 | 93.2 | 57.7 | 397.6 | 33.6 | 4.23 |
| 70 | 90.0 | 305.4 | 61.2 | 421.7 | 10.0 | 1.26 |
| 78 | −255.2 | 113.6 | 18.0 | 124.1 | 10.0 | 1.26 |
| 88 | −295.3 | 91.3 | 57.9 | 399.4 | 12.0 | 1.52 |
| 94 | −317.5 | 79.0 | 17.5 | 120.7 | 28.0 | 3.53 |
| 100 | −287.3 | 95.8 | 59.1 | 407.6 | 11.8 | 1.49 |
| 102 | −300.0 | 88.7 | 58.6 | 404.2 | 0.1 | 0.01 |
| 104 | −300.0 | 88.7 | 58.6 | 404.2 | 11.7 | 1.47 |
| 108 | −302.1 | 87.5 | 20.0 | 137.9 | 27.6 | 3.48 |
| 110 | −292.3 | 93.0 | 47.0 | 324.0 | 15.9 | 2.00 |
| 112 | −300.1 | 88.7 | 46.0 | 317.5 | 16.7 | 2.10 |
| 114 | −317.9 | 78.8 | 17.0 | 117.2 | 77.6 | 9.77 |
| 116 | 83.6 | 301.8 | 14.9 | 102.7 | 78.2 | 9.86 |
| 118 | −293.9 | 92.1 | 18.4 | 126.6 | 21.7 | 2.74 |
| 120 | 83.6 | 301.8 | 17.4 | 119.7 | 21.7 | 2.74 |

TABLE 2

| Stream | Mole Fraction | | |
|---|---|---|---|
| In Line Number | Nitrogen | Argon | Oxygen |
| 10 | 0.7812 | 0.0093 | 0.2095 |
| 18 | 0.7812 | 0.0093 | 0.2095 |
| 22 | 0.7812 | 0.0093 | 0.2095 |
| 30 | 0.7812 | 0.0093 | 0.2095 |
| 36 | 0.7812 | 0.0093 | 0.2095 |
| 38 | 0.7812 | 0.0093 | 0.2095 |
| 40 | 0.7812 | 0.0093 | 0.2095 |
| 46 | 0.7812 | 0.0093 | 0.2095 |
| 48 | 0.7812 | 0.0093 | 0.2095 |
| 50 | 0.7812 | 0.0093 | 0.2095 |
| 52 | 0.7812 | 0.0093 | 0.2095 |
| 70 | 0.7812 | 0.0093 | 0.2095 |
| 78 | 0.7812 | 0.0093 | 0.2095 |
| 88 | 0.9867 | 0.0042 | 0.0090 |
| 94 | 0.9867 | 0.0042 | 0.0090 |
| 100 | 0.5717 | 0.0145 | 0.4138 |
| 102 | 0.5717 | 0.0145 | 0.4138 |
| 104 | 0.5717 | 0.0145 | 0.4138 |
| 108 | 0.5679 | 0.0148 | 0.4172 |
| 110 | 0.5652 | 0.0150 | 0.4197 |
| 112 | 0.9871 | 0.0039 | 0.0090 |
| 114 | 0.9933 | 0.0030 | 0.0036 |
| 116 | 0.9933 | 0.0030 | 0.0036 |
| 118 | 0.0180 | 0.0320 | 0.9500 |
| 120 | 0.0180 | 0.0320 | 0.9500 |

In another example, selected flow rates and pressures in the three-column dual reboiler cycle (shown in FIG. 3) and in the conventional dual reboiler cycle (shown in FIG. 1), both producing 95% oxygen, were compared. This comparison is shown in Table 3 below. Using the cycle shown in FIG. 3 results in a power savings. Specifically, because a significant portion of the feed is separated in the medium pressure column in the cycle of FIG. 3, a smaller amount of the feed needs to be compressed to the high pressure column pressure. In this example, the power of the three-column cycle (of FIG. 3) is 4% lower than the power of the conventional dual reboiler cycle (of FIG. 1 ).

TABLE 3

| | Stream or Apparatus Number | Unit | Present Invention FIG. 3 | Dual Reboiler Cycle FIG. 1 |
|---|---|---|---|---|
| Feed | 10 | mole/s | 100 | 100 |
| Oxygen Product | 120 | mole/s | 21.7 | 21.7 |
| Nitrogen Product | 116 | mole/s | 78.2 | 78.2 |
| Compressor Flow | 10 | mole/s | 100 | 100 |
| Compressor Discharge Pressure | 12 | kPa | 331.3 | 442.7 |
| Compressore Flow | 30 | mole/s | 70.4 | — |
| Compressor Discharge | 32 | kPa | 435.6 | — |

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. A method of operating a cryogenic distillation column having a higher pressure stage, a lower pressure stage, and a medium pressure stage, to produce at least one of nitrogen and impure oxygen, said method comprising the steps of:

providing from a source of feed air (a) a first feed air stream having a first pressure and (b) a second feed air stream having a second pressure less than said first pressure;

introducing said second feed air stream into said medium pressure stage for rectification into a medium pressure, oxygen-enriched liquid and a medium pressure nitrogen overhead stream;

introducing a first fraction of said first feed air stream into said higher pressure stage for rectification into a higher pressure, oxygen-enriched liquid and a higher pressure nitrogen overhead stream;

condensing said higher pressure nitrogen overhead stream against a liquid from said lower pressure stage to form higher pressure nitrogen condensate and returning a portion of said higher pressure nitrogen condensate to said higher pressure stage as reflux;

reducing the pressure of at least a portion of at least one of said medium pressure, oxygen-enriched liquid and said higher pressure, oxygen-enriched liquid to form a first reduced-pressure, oxygen-enriched liquid;

condensing said medium pressure nitrogen overhead stream against said first reduced-pressure, oxygen-enriched liquid, resulting in an oxygen-enriched vapor stream and a medium pressure nitrogen condensate, and returning a portion of said medium pressure nitrogen condensate to said medium pressure stage as reflux;

introducing the remaining portion of at least one of said higher pressure nitrogen condensate and said medium pressure nitrogen condensate to said lower pressure stage as reflux;

introducing said oxygen-enriched vapor stream to said lower pressure stage as feed;

withdrawing an oxygen-enriched product from a position near the bottom of said lower pressure stage; and withdrawing a nitrogen-enriched product from a position near the top of said lower pressure stage.

2. The method of claim 1, wherein the step of condensing said higher pressure nitrogen overhead stream against a liquid from said lower pressure stage includes introducing said higher pressure nitrogen overhead stream to an intermediate reboiler/condenser of said lower pressure stage, said method further comprising:

condensing a second fraction of said first feed air stream in a bottom reboiler/condenser of said lower pressure stage to form liquefied feed air; and introducing at least a portion of said liquefied feed air to at least one of said higher pressure stage, said medium pressure stage, and said lower pressure stage.

3. The method of claim 2, further comprising:

cooling and expanding a third fraction of said first feed air stream to form a third feed air stream having a third pressure less than said second pressure; and introducing said third feed air stream to said lower pressure stage.

4. The method of claim 1 further comprising:

heating said oxygen-enriched product against said first feed air stream and said second feed air stream in a first heat exchanger;

heating said nitrogen-enriched product against:

(a) said first feed air stream and said second feed air stream in said first heat exchanger;

(b) said higher pressure nitrogen condensate and said medium pressure nitrogen condensate in a second heat exchanger; and (c) said higher pressure, oxygen-enriched liquid in a third heat exchanger.

5. The method of claim 1, wherein:

the step of reducing the pressure of at least a portion of at least one of said medium pressure, oxygen-enriched liquid and said higher pressure, oxygen-enriched liquid comprises:

(a) first reducing the pressure of said higher pressure, oxygen-enriched liquid to form a second reduced-pressure oxygen-enriched liquid;

(b) combining said second reduced-pressure oxygen-enriched liquid with said medium pressure, oxygen-enriched liquid to form a combined oxygen-enriched liquid; and (c) reducing the pressure of a first portion of said combined oxygen-enriched liquid to form said first reduced-pressure oxygen-enriched liquid;

the step of condensing said medium pressure nitrogen overhead stream includes introducing said first reduced-pressure oxygen-enriched liquid to a top reboiler/condenser of said medium pressure stage to form said oxygen-enriched vapor stream and to condense said medium pressure nitrogen overhead stream;

said method further comprising:

reducing the pressure of a second portion of said combined oxygen-enriched liquid to form fourth reduced-pressure oxygen-enriched liquid; and introducing said fourth reduced-pressure oxygen-enriched liquid to said lower pressure stage.

6. The method of claim 1, wherein:

the step of reducing the pressure of at least a portion of at least one of said medium pressure, oxygen-enriched liquid and said higher pressure, oxygen-enriched liquid comprises:

(a) first reducing the pressure of said higher pressure, oxygen-enriched liquid to form second reduced-pressure oxygen-enriched liquid;

(b) combining said second reduced-pressure oxygen-enriched liquid with said medium pressure, oxygen-enriched liquid to form a combined oxygen-enriched liquid; and (c) reducing the pressure of all of said combined oxygen-enriched liquid to form said first reduced-pressure oxygen-enriched liquid; and the step of condensing said medium pressure nitrogen overhead stream includes introducing said first reduced-pressure oxygen-enriched liquid to a top reboiler/condenser of said medium pressure stage to form said oxygen-enriched vapor stream and to condense said medium pressure nitrogen overhead stream.

7. The method of claim 1, wherein:

the step of condensing said higher pressure nitrogen overhead stream against a liquid from said lower pressure stage includes introducing said higher pressure nitrogen overhead stream to a bottom reboiler/condenser of said lower pressure stage; and the step of withdrawing an oxygen-enriched product from a position near the bottom of said lower pressure stage comprises withdrawing said oxygen-enriched product as a liquid and introducing said oxygen-enriched product to a top reboiler/condenser of said lower pressure stage to provide additional reflux to said lower pressure stage and to vaporize said oxygen-enriched product.

8. The method of claim 1, wherein:

the step of condensing said higher pressure nitrogen overhead stream against a liquid from said lower pressure stage includes the steps of:

(a) introducing a first portion of said higher pressure nitrogen overhead stream to a bottom reboiler/condenser of said lower pressure stage; and (b) introducing a second portion of said higher pressure nitrogen overhead stream to a side reboiler/condenser of said lower pressure stage; and the step of withdrawing an oxygen-enriched product from a position near the bottom of said lower pressure stage comprises the steps of:

(a) withdrawing said oxygen-enriched product as a liquid;

(b) reducing the pressure of said oxygen-enriched product to form a reduced-pressure, oxygen-enriched product; and (c) introducing said reduced-pressure, oxygen-enriched product to said side reboiler/condenser to vaporize said reduced-pressure, oxygen-enriched product.

9. The method of claim 1, wherein:

the step of reducing the pressure of at least a portion of at least one of said medium pressure, oxygen-enriched liquid and said higher pressure, oxygen-enriched liquid comprises first reducing the pressure of said higher pressure, oxygen-enriched liquid to form second reduced-pressure oxygen-enriched liquid;

said method further comprises introducing said second reduced-pressure oxygen-enriched liquid to said medium pressure stage;

the step of reducing the pressure of at least a portion of at least one of said medium pressure, oxygen-enriched liquid and said higher pressure, oxygen-enriched liquid further comprises reducing the pressure of said medium pressure, oxygen-enriched liquid to form said first reduced-pressure oxygen-enriched liquid; and the step of condensing said medium pressure nitrogen overhead stream includes introducing at least a portion of said first reduced-pressure oxygen-enriched liquid to a top reboiler/condenser of said medium pressure stage to form said oxygen-enriched vapor stream and to condense said medium pressure nitrogen overhead stream.

10. The method of claim 1, wherein the step of compressing and cooling said feed air comprises:

first compressing said feed air to said first pressure to form said first feed air stream; and expanding a portion of said first feed air stream to form said second feed air stream.

11. The method of claim 1 further comprising partially separating said reduced-pressure, oxygen-enriched liquid as said reduced-pressure, oxygen-enriched liquid is vaporized to form a first portion of said oxygen-enriched vapor stream having a first concentration and a second portion of said oxygen-enriched vapor stream having a second concentration, and wherein the step of introducing said oxygen-enriched vapor stream to said lower pressure stage as feed comprises:

introducing said first portion of said oxygen-enriched vapor stream to a first location of said lower pressure stage; and introducing said second portion of said oxygen-enriched vapor stream to a second location of said lower pressure stage.

12. The method of claim 1, wherein:

the step of withdrawing said oxygen-enriched product from a position near the bottom of said lower pressure stage comprises withdrawing said oxygen-enriched product as a liquid;

said method further comprises pressurizing said oxygen-enriched product to form a pressurized oxygen-enriched product;

the step of compressing and cooling said feed air includes further compressing a second fraction of said first feed air stream to form a fourth feed air stream having a fourth pressure higher than said first pressure; and vaporizing and heating said pressurized oxygen-enriched product against said fourth feed air stream.

13. The method of claim 1, wherein the step of compressing and cooling said feed air comprises:

compressing a first portion of said feed air to said first pressure to form said first feed air stream and compressing a second portion of said feed air to said second pressure to form said second feed air stream; and cooling said first feed air stream and said second feed air stream in a first heat exchanger.

14. The method of claim 1, wherein the step of condensing said higher pressure nitrogen overhead stream against a liquid from said lower pressure stage includes introducing said higher pressure nitrogen overhead stream to an intermediate reboiler/condenser of said lower pressure stage, said method further comprising:

condensing a second fraction of said first feed air stream in a bottom reboiler/condenser of said lower pressure stage to form liquefied feed air;

introducing a first portion of said liquefied feed air to said higher pressure stage;

introducing a second portion of said liquefied feed air to said medium pressure stage; and introducing a third portion of said liquefied feed air to said lower pressure stage.

15. A method of operating a cryogenic distillation column having a higher pressure stage, a lower pressure stage, and a medium pressure stage, to produce at least one of nitrogen and impure oxygen, said method comprising the steps of:

(a) compressing and cooling feed air to provide (i) a first feed air stream having a first pressure and (ii) a second feed air stream having a second pressure less than said first pressure;

(b) introducing said second feed air stream into said medium pressure stage for rectification into a medium pressure, oxygen-enriched liquid and a medium pressure nitrogen overhead stream;

(c) introducing a first fraction of said first feed air stream into said higher pressure stage for rectification into a higher pressure, oxygen-enriched liquid and a higher pressure nitrogen overhead stream;

(d) condensing said higher pressure nitrogen overhead stream against a liquid from said lower pressure stage to form higher pressure nitrogen condensate and returning a first portion of said higher pressure nitrogen condensate to said higher pressure stage as reflux and introducing a second portion of said higher pressure nitrogen condensate to said lower pressure stage as reflux;

(e) withdrawing an oxygen-enriched product from a position near the bottom of said lower pressure stage; and (f) withdrawing a nitrogen-enriched product from a position near the top of said lower pressure stage, characterized in that the method further comprises:

(g) reducing the pressure of at least a portion of at least one of said medium pressure, oxygen-enriched liquid and said higher pressure, oxygen-enriched liquid to form a first reduced-pressure, oxygen-enriched liquid;

(h) condensing said medium pressure nitrogen overhead stream against said first reduced-pressure, oxygen-enriched liquid, resulting in an oxygen-enriched vapor stream and a medium pressure nitrogen condensate, and returning a first portion of said medium pressure nitrogen condensate to said medium pressure stage as reflux and introducing a second portion of said medium pressure nitrogen condensate to said lower pressure stage as reflux; and (i) introducing said oxygen-enriched vapor stream to said lower pressure stage as feed.

* * * * *